US012091937B2

(12) United States Patent
Lai et al.

(10) Patent No.: US 12,091,937 B2
(45) Date of Patent: Sep. 17, 2024

(54) AUTOFILL, CIRCULATION, AND PRODUCTION VALVE FOR WELL COMPLETION SYSTEMS

(71) Applicant: Schlumberger Technology Corporation, Sugar Land, TX (US)

(72) Inventors: Weichen Lai, Pearland, TX (US); Travis Hohenberger, Sugarland, TX (US); Rex Mennem, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 87 days.

(21) Appl. No.: 18/000,426

(22) PCT Filed: Jun. 10, 2021

(86) PCT No.: PCT/US2021/036781
§ 371 (c)(1),
(2) Date: Dec. 1, 2022

(87) PCT Pub. No.: WO2021/252744
PCT Pub. Date: Dec. 16, 2021

(65) Prior Publication Data

US 2023/0220747 A1 Jul. 13, 2023

Related U.S. Application Data

(60) Provisional application No. 63/038,246, filed on Jun. 12, 2020.

(51) Int. Cl.

| | |
|---|---|
| ***E21B 34/14*** | (2006.01) |
| ***E21B 34/10*** | (2006.01) |
| ***E21B 43/12*** | (2006.01) |

(52) U.S. Cl.
CPC ..... *E21B 34/14* (2013.01); *E21B 34/102* (2013.01); *E21B 43/12* (2013.01); *E21B 2200/06* (2020.05)

(58) Field of Classification Search
CPC ..... E21B 34/14; E21B 34/102; E21B 43/12; E21B 2200/06
See application file for complete search history.

(56) References Cited

U.S. PATENT DOCUMENTS 4,298,077 A * 11/1981 Emery ..... E21B 21/103 175/243
4,771,831 A 9/1988 Pringle
(Continued)

FOREIGN PATENT DOCUMENTS

| | | |
|---|---|---|
| EP | 1550789 A1 | 7/2005 |
| WO | 0246575 A1 | 6/2002 |

OTHER PUBLICATIONS

International Search Report and Written Opinion issued in PCT Application PCT/US2021/036781, dated Oct. 20, 2021 (10 pages).

*Primary Examiner* — D. Andrews
(74) *Attorney, Agent, or Firm* — Jeffrey D. Frantz

(57) ABSTRACT

A valve for use in a wellbore includes a replaceable choke device that is threaded into at least one opening formed through a sidewall of a tubular housing of the valve. The choke device is sealable on the sidewall of the tubular housing with an elastomeric sealing component, and the choke device controls at least one of fluid pressure within the tubular string and a pressure drop across the valve. The valve also includes a flow sleeve carried by the tubular housing for movement relative thereto between a first position in which fluid flow s permitted across the valve, a second position in which the flow sleeve prevents fluid flow across the valve,
(Continued)

Open Position and a third position in which the flow sleeve is locked in place relative to the tubular housing by a lock ring.

20 Claims, 3 Drawing Sheets

(56) References Cited

U.S. PATENT DOCUMENTS

| | | | | |
|---|---|---|---|---|
| 5,181,569 | A | 1/1993 | McCoy | |
| 5,609,178 | A | 3/1997 | Hennig et al. | |
| 6,059,038 | A | 5/2000 | Vick, Jr. | |
| 7,108,071 | B2 * | 9/2006 | Freiheit | E21B 21/103 166/383 |
| 9,255,456 | B2 * | 2/2016 | Evans | E21B 21/103 |
| 2013/0168099 | A1 | 7/2013 | Themig | |
| 2013/0312965 | A1 * | 11/2013 | Themig | E21B 34/14 166/135 |

* cited by examiner

Open Position

Closed Position - Temporary

Closed Position - Permanent

AUTOFILL, CIRCULATION, AND PRODUCTION VALVE FOR WELL COMPLETION SYSTEMS

CROSS-REFERENCE TO RELATED APPLICATION

This application is a National Stage Entry of International Application No. PCT/US2021/036781, filed Jun. 10, 2021, which is based on and claims priority to U.S. Provisional Application Ser. No. 63/038,246, filed Jun. 12, 2020, which is incorporated herein by reference in its entirety.

BACKGROUND

When a completion string is run in a well, it is generally advantageous to allow entry of fluid in the well into the tubular string as the tubular string is being lowered into the well. It is also generally advantageous to allow circulation capabilities across sidewalls of a tubular string when the tubular string is run in hole. Moreover, in order to ensure successful operations, it is generally considered good practice to pressure test the tubular string periodically as it is being run in the well. Finally, after the tubular string has been installed and pressure testing has concluded, or in other situations, it may be advantageous to prevent fluid flow through the tubular string wall. From the foregoing, there is a continuing need to provide improved apparatus and methods that realize the aforementioned functionalities.

SUMMARY

According to one or more embodiments of the present disclosure, a valve for use in a wellbore includes: a tubular housing have at least one opening formed through a sidewall thereof, the tubular hosing connectable with a tubular string via an upper sub and a lower sub; a replaceable choke device that is threaded into the at least one opening formed through the sidewall of the tubular housing, wherein the replaceable choke device controls at least one of fluid pressure within the tubular string, and a pressure drop across the valve; and a flow sleeve carried by the tubular housing for movement relative thereto between a first position in which fluid flow is permitted across the valve, a second position in which the flow sleeve prevents fluid flow across the valve, and a third position in which the flow sleeve is locked in place relative to the tubular housing by a lock ring.

In a method of operating a valve positioned in a wellbore along a tubular according to one or more embodiments of the present disclosure, the method includes: initiating fluid flow though the tubular string and to the valve adequate to shift a flow responsive sleeve of the valve from a first open position to a second closed position; with the valve in the second closed position, reducing or removing fluid flow through the tubular string and to the valve to shift the flow responsive sleeve from the second closed position to the first open position; and with the valve at the second closed position, increasing fluid pressure in the tubular string to shift the valve from the second closed position to a third closed position.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
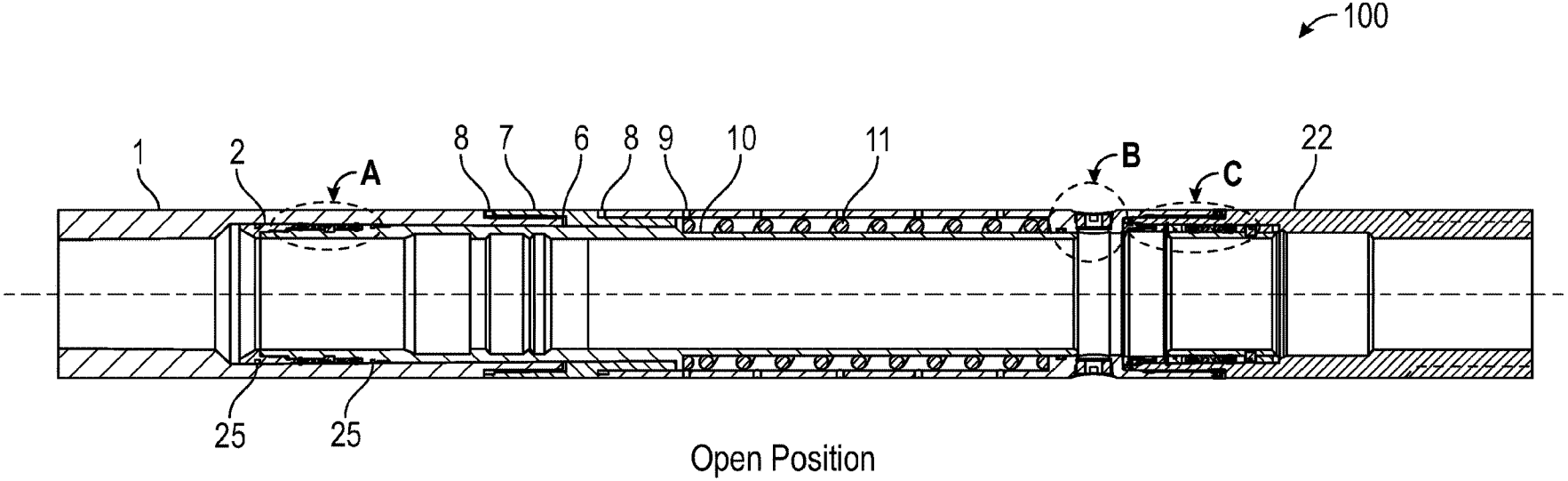
FIG. 1 shows a cross-sectional product layout of an apparatus according to one or more embodiments of the present disclosure in an open position.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims: the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure.

One or more embodiments of the present disclosure relates generally relate to equipment utilized in conjunction with wellsite operations. More specifically, one or more embodiments of the present disclosure provide an apparatus for certain practical and important downhole functionalities for a tubular string, including: (1) automatically filling a tubular string as it is run in a well; (2) allowing steady circulation from tubular to annulus, or vice versa, as the tubular string is run in a well; (3) pressure testing the tubular string as it is run in a well; and (4) preventing fluid flow through the tubular sidewall at desired instances.

First, when a completion string is run in a well, it is generally advantageous for fluid in the well to enter the tubular string as the tubular string is being lowered into the well. In this manner, fluid pressure in the tubular string may be equalized. With that, in an annulus formed between the tubular string and the wellbore, subsequent operations that require fluid in the tubular string are made more convenient.

Second, it is also generally advantageous to allow circulation capabilities across sidewalls of the tubular string when the tubular string is run in hole. For example, when a formation is under loss, it is beneficial to be able to pump down tubing lost circulation material to maintain well stability. On the other hand, if objects (e.g., debris, balls, etc.) in the tubing string need to be circulated out of the well, it is beneficial to be able to pump down the annulus and circulate fluid out of the tubing string.

Third, in order to ensure successful operations, it is generally considered good practice to pressure test the tubular string periodically as the tubular string is being run in the well. However, if the tubular string is open-ended, or otherwise open to fluid communication with the annulus, (e.g., via an opening formed through a sidewall of the tubular string), it may be difficult or uneconomical to periodically close off the opening to perform the pressure test, and then reopen the tubular string so that the tubular string may continue to fill while it is lowered further in the well. Additionally, when other items of equipment are pressure tested, such as after setting a packer, it may be advantageous to permit fluid flow through the opening in the tubular string. Thus, it may be seen that the ability to open and close the opening in the tubular string at will to permit automatic filling of the tubular string, pressure testing of the tubular string, and pressure testing of other equipment in the well, is very beneficial in these operations.

Fourth, after the tubular string has been installed and pressure testing has concluded, or in other situations, it is sometimes advantageous to prevent fluid flow through the tubular string sidewall. For example, after a production tubing string has been installed, it may be desirable to close off any opening through the tubing string sidewall, except at particular locations. Thus, an apparatus that permits automatic filling of a tubular string should, in some cases, have the capability of preventing any fluid flow through a sidewall of the apparatus. As further described below, a valve and corresponding method according to one or more embodiments of the present disclosure integrates the four aforementioned functionalities to facilitate shifting of the valve into three positions by simply turning on/off tubular flow rates.

Figure 2:
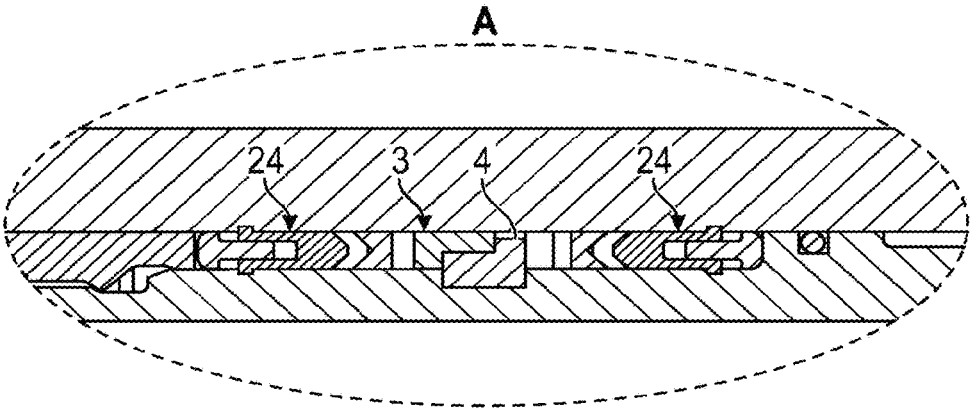
FIG. 2 shows further detail of portion A shown in FIG. 1 according to one or more embodiments of the present disclosure.
Figure 3:
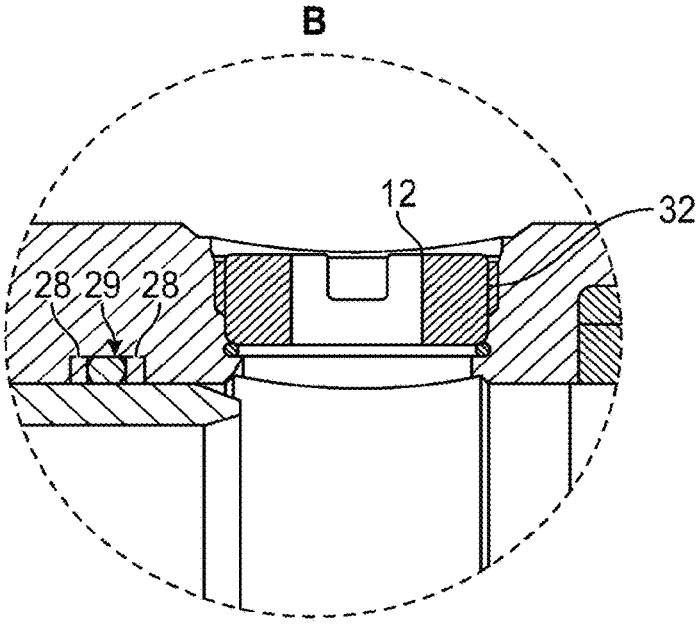
FIG. 3 shows further detail of portion B shown in FIG. 1 according to one or more embodiments of the present disclosure.
Figure 4:
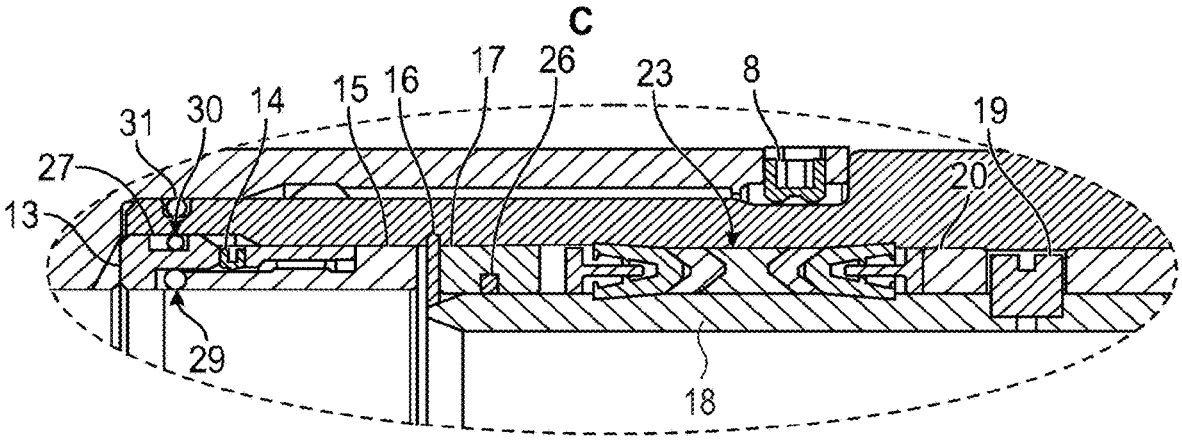
FIG. 4 shows further detail of portion C shown in FIG. 1 according to one or more embodiments of the present disclosure.

An apparatus according to one or more embodiments of the present disclosure controls fluid flow of a tubular string in a wellbore in response to a pressure drop in the apparatus. Referring now to FIG. 1, a cross-sectional product layout of a valve 100 according to one or more embodiments of the present disclosure in an open position is shown. Further, FIGS. 2, 3 and 4 show further detail of portions A, B, and C shown in FIG. 1, respectively, according to one or more embodiments of the present disclosure. An auto-fill circulation valve 100 according to one or more embodiments of the present disclosure includes a set of choke devices 12 in a tubular housing 9. The choke devices 12 can be configured in various quantities and choke hole sizes to produce either a steady flow across the tubular string, or a desired pressure drop in the valve 100. The valve 100 body contains four sets of seals 23, 24, 29, 30 and a flow sleeve 10 that change the valve states 100 between first (open), second (temporarily closed), and third (permanently closed) positions in response to a pressure drop in the valve 100. A replaceable spring 11 in the valve 100 is designed to bias a certain piston effect force generated by the pressure drop in the valve 100. A set of shear devices 19, 20 is included in the lower section of the valve 100, which activates and shifts the shear sleeve 18 in a downward direction when a desired flow-induced pressure drop is achieved in the valve 100. After the shear sleeve 18 shifts and the flow sleeve 10 engages the lower seal units 23, a lock ring 6 locks the valve 100 in the closed position, preventing any further fluid communication across the valve 100. As shown in FIG. 1, for example, the lock ring 6 may be a component of a lock ring housing 7 in one or more embodiments of the present disclosure. The lock ring housing 7 may be affixed to the upper sub 1 of the valve 100, and the tubular housing 9 may be affixed to the lock ring housing 7 via at least one screw 8 or other type of fastener according to one or more embodiments of the present disclosure.

As previously mentioned, the valve 100 according to one or more embodiments of the present disclosure includes a set of choke device 12 in a tubular housing 9. More specifically, the tubular housing 9 of the valve 100 includes at least one opening formed through a sidewall of the tubular housing 9, and a replaceable choke device 12 is threaded into the at least one opening formed through the sidewall of the tubular housing 9, as shown in FIGS. 1 and 3. As shown in FIG. 3, the replaceable choke device 12 may be sealable on the sidewall of the tubular housing 9 with an elastomeric sealing component 32, for example. As further shown in FIG. 1, the tubular housing 9 is connectable with a tubular string via an upper sub 1 and a lower sub 22 of the valve 100. In one or more embodiments of the present disclosure, the replaceable choke device 12 controls at least one of fluid pressure within the tubular string, and a pressure drop across the valve 100. Advantageously, the replaceable choke device 12 is a flow restriction device that may be replaced at different times or locations of service in one or more embodiments of the present disclosure.

Figure 5A:
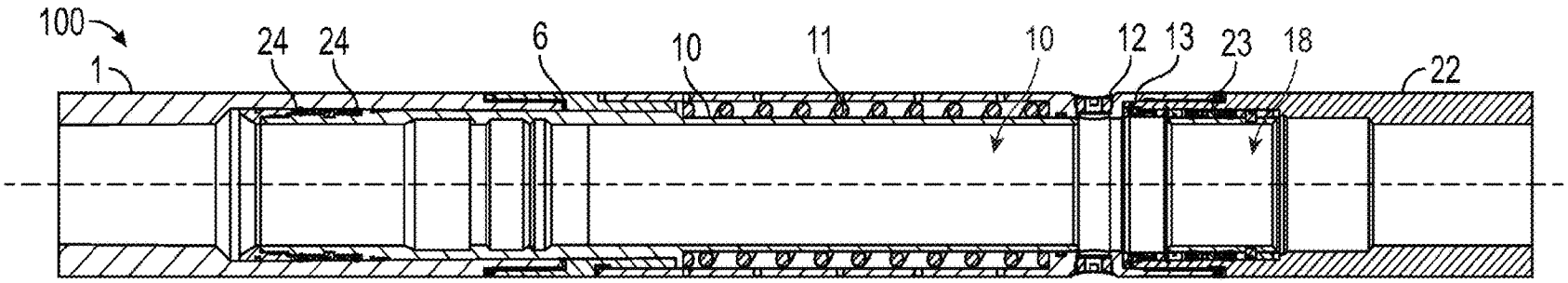
FIG. 5A-5C show a cross-sectional product layout of an apparatus according to one or more embodiments of the present disclosure in different operating positions.
Figure 5B:
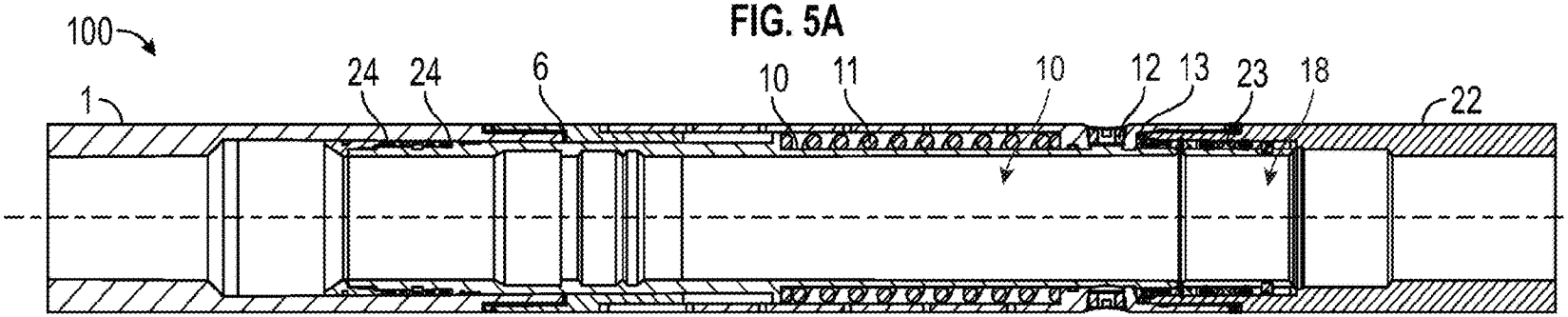
Figure 5C:
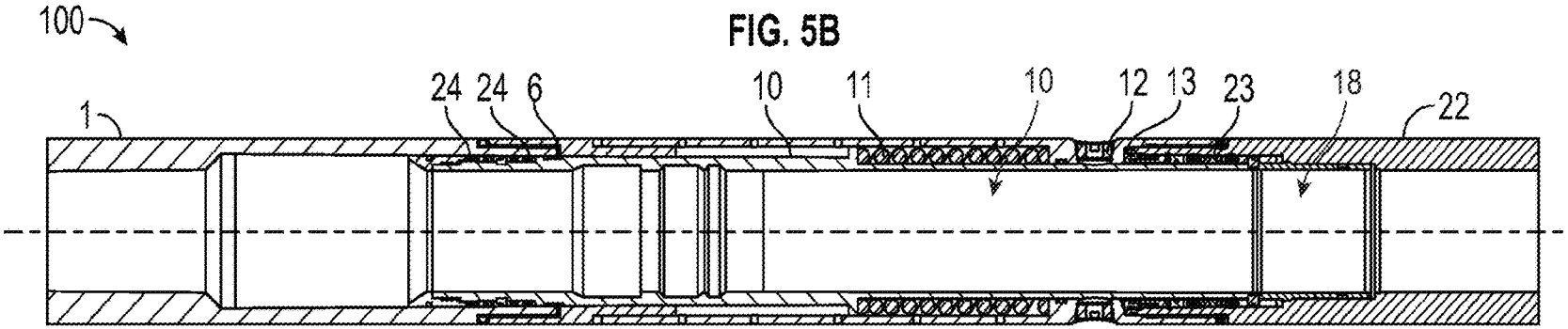

Still referring to FIG. 1, the valve 100 includes a flow sleeve 10 carried by the tubular housing 9 for movement relative to the tubular housing 9 between a first position (FIGS. 1, 5A) in which fluid flow is permitted across the valve, a second position (FIG. 5B) in which the flow sleeve 10 prevents fluid flow across the valve 100, and a third position (FIG. 5C) in which the flow sleeve 10 is locked in place relative to the tubular housing 9 by a lock ring 6. In this way, the valve 100 according to one or more embodiments of the present disclosure respectively opens, temporarily closes, or permanently closes bypass ports in response to flow-induced pressure in the valve 100. In one or more embodiments of the present disclosure, the valve 100 is operable from a remote surface location. As further described below, the valve bypass ports may be repeatedly cycled from the first open position to the second temporarily closed position by selectively raising and lowering the fluid pressure, according to one or more embodiments of the present disclosure. As previously described, one or more of the replaceable choke devices 12, which are sized to produce a desired flow-induced pressure drop across the valve 100, may control the fluid pressure within the valve 100.

As shown in FIGS. 1-3, the flow sleeve 10 includes a first set of sealing units 24, 29 in one or more embodiments of the present disclosure. The first set of sealing units 24, 29 includes differential sealing units according to one or more embodiments of the present disclosure. In this way, the first set of sealing units 24, 29 generates a piston effect force and pushes the flow sleeve 10 downward when a sufficient flow-induced pressure drop is achieved within the valve 100. For example, the piston effect generated by the first set of sealing units 24, 29, shifts the flow sleeve 10 from the first position to the second position, and from the second position to the third position, according to one or more embodiments of the present disclosure. In one or more embodiments, the downward movement of the flow sleeve 10 allows the flow sleeve 10 to seal on a second set of sealing units 29, 30 within a sealing carrier 13 of the valve 100 (FIGS. 3, 4), reaching the temporarily closed second position. The sealing carrier 13 provides sealing and prevents flow across the valve 100 when the valve 100 is in the second position (i.e., the temporary closed position). As shown in FIG. 4, in addition to the second set of sealing units, the sealing carrier 13 may also include a back-up ring 27, and o-rings 15, 31, for example. In one or more embodiments of the present disclosure, a retaining ring 16, such as a c-type retaining ring, may be used to hold the position of the sealing carrier 13 when the valve 100 is in the second position. In this second position, communication between the tubular string and an annulus of the wellbore is isolated by sealing units 24, 29, 30, allowing tubing pressure testing. In one or more embodiments of the present disclosure, one or both of the first and second sealing units 24, 29, 30 may be protected by at least one back-up ring 28 as shown in FIG. 3, for example. Further, the sealing carrier 13 may be affixed to the valve 100 with a screw 14 or another type of fastener, as shown in FIG. 4, for example.

In addition to the above, the flow sleeve 10 is capable of shifting from the second position back to the first position in one or more embodiments of the present disclosure. As shown in FIG. 4, and as further described below, a set of replaceable shear devices 19, 20 along a shear sleeve 18 limits the pressure that can be applied by preventing the flow sleeve 10 from moving from the second position to third position until shear device activation occurs. In one or more embodiments of the present disclosure, the valve 100 includes a biasing spring 11, as shown in FIG. 1. When tubular flow/pressure is removed from surface, the biasing spring 11 pushes the flow sleeve 10 upward, shifting the valve 100 from the second temporarily closed position (FIG. 5B) back to the first open position (FIG. 1, 5A). In this way, the valve 100 and the associated method according to one or more embodiments of the present disclosure allows free, two-way movement of the flow sleeve 10 until shear device activation, which locks the valve 100 permanently closed in the third position when desired.

As previously described, a set of shear devices 19, 20 along a shear sleeve 18 limits the pressure that can be applied by preventing the flow sleeve 10 from moving from the second position to third position until shear device activation occurs. That is, when a desired flow-induced pressure drop is achieved across the valve 100, the set of shear devices 19, 20 shears, causing shear device activation, which shifts the shear sleeve 18. Stated another way, the set of shear devices 19, 20 and the shear sleeve 18 prevent the flow sleeve 10 from moving from the second position to the third position until the shear device activation. Once the flow sleeve 10 moves from the second position to the third position after shear device activation, the lock ring 6 locks the valve 100 in the third position by expanding into a groove of the flow sleeve 10. Using the set of shear devices 19, 20 of the shear sleeve 18 in this way is beneficial insofar as the pressure required for a tubing pressure test does not affect the pressure drop required to change the valve state (i.e., position) of the valve 100, thereby making higher tubing pressure tests possible.

As shown in FIGS. 2 and 4, the valve 100 may also include at least one production seal stack 23, 24 according to one or more embodiments of the present disclosure. For example, as shown in FIGS. 1, 2, and 4, the production seal stack 23, 24 may be protected by one or more of the upper sub 1, the lower sub 22, and one or more debris barrier rings 25, 26, with or without a seal bearing ring 17, as the tubular string is run in the wellbore or is otherwise in service, according to one or more embodiments of the present disclosure. An upper seal cap 2 of the valve 100 may further protect the production seal stack 23, as shown in FIGS. 1 and 2, for example. In one or more embodiments of the present disclosure, one or both of the production seal stacks 23, 24 may prevent flow across the valve 100 when the valve 100 is in the third permanently closed position. In this way, one or both of the production seal stacks 23, 24 may be activated to provide sealing when the flow sleeve 10 seals on one or both of the production seal stacks 23, 24 upon shear device activation (i.e., shifting of the shear sleeve 18), as the flow sleeve 10 assumes the third permanently closed position. In one or more embodiments of the present disclosure, a retaining ring 3, such as a c-type retaining ring 4, may be used to hold the position of the of the production seal stacks 23, 24 when the valve 100 is in the third position.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A valve for use in a wellbore, comprising:

a tubular housing having at least one opening formed through a sidewall thereof, the tubular housing connectable with a tubular string via an upper sub and a lower sub;

a replaceable choke device that is threaded into the at least one opening formed through the sidewall of the tubular housing, wherein the replaceable choke device is sealable on the sidewall of the tubular housing with an elastomeric sealing component, and wherein the replaceable choke device controls at least one of fluid pressure within the tubular string, and a pressure drop across the valve;

a flow sleeve carried by the tubular housing for movement relative thereto between a first position in which fluid flow is permitted across the valve, a second position in which the flow sleeve prevents fluid flow across the valve, and a third position in which the flow sleeve is locked in place relative to the tubular housing by a lock ring; and a production seal stack that is configured to prevent fluid flow across the valve, wherein the production seal stack does not seal against the flow sleeve in the first position and in the second position, and wherein the production seal stack seals against the flow sleeve in the third position.

2. The valve of claim 1, wherein the replaceable choke device is configured to a desired choke hole size to provide a desired pressure drop in the valve.

3. The valve of claim 1, further comprising at least one differential sealing unit that provides a piston effect to shift the flow sleeve from the first position to the second position, and from the second position to the third position, in response to a flow-induced pressure drop.

4. The valve of claim 1, further comprising a biasing spring that pushes the flow sleeve from the second position to the first position when tubular flow is removed.

5. The valve of claim 1, wherein the lock ring is configured to lock the valve in the third position.

6. The valve of claim 1, further comprising a sealing carrier that is configured to provide sealing and prevent flow across the valve when the valve is in the second position.

7. The valve of claim 1, further comprising:

a sealing carrier that is configured to provide sealing and prevent flow across the valve when the valve is in the second position; and a retaining ring that is configured to hold positions of the sealing carrier and the production seal stack.

8. The valve of claim 1, further comprising a shear sleeve that is maintained in an initial position by one or more shear devices, wherein when a desired flow-induced pressure drop is achieved across the valve, the flow sleeve shifts the shear sleeve past the one or more shear devices to enable the flow sleeve to move from the second position to the third position.

9. The valve of claim 8, wherein the production seal stack engages against the shear sleeve when the flow sleeve is in the first position and in the second position, and wherein the production seal stack engages against the flow sleeve when the flow sleeve is in the third position.

10. The valve of claim 8, wherein the shear sleeve is positioned downhole from the flow sleeve.

11. The valve of claim 8, wherein the production seal stack is protected by the shear sleeve and by one or more debris barrier rings when the shear sleeve is maintained in the initial position.

12. The valve of claim 8, wherein when the flow sleeve is in the third position, the flow sleeve occupies at least some of a space that the shear sleeve occupies in the initial position of the shear sleeve.

13. A method of operating a valve positioned in a wellbore along a tubular string, the method comprising:

initiating fluid flow through the tubular string and to the valve adequate to shift a flow responsive sleeve of the valve from a first open position to a second closed position;

with the valve in the second closed position, reducing or removing fluid flow through the tubular string and to the valve to shift the flow responsive sleeve of the valve from the second closed position to the first open position;

with the valve at the second closed position, increasing fluid pressure in the tubular string to shift the flow responsive sleeve of the valve from the second closed position to a third closed position; and with the valve at the third closed position, sealing a production seal stack against the flow responsive sleeve to prevent the fluid flow from flowing across the valve, wherein the production seal stack does not seal against the flow responsive sleeve when the flow responsive sleeve is in the first open position and in the closed second position.

14. The method of claim 13, wherein the valve is operable from a remote surface location.

15. The method of claim 13, further comprising controlling at least one of the fluid flow through the tubular string and a pressure drop across the valve via a replaceable choke device sealable through a sidewall of a tubular housing of the valve.

16. The method of claim 15, wherein the replaceable choke device is configured to a desired choke hole size to provide a desired pressure drop within the wellbore when active flow is present across the valve.

17. The method of claim 16, wherein shifting the valve from the second closed position to the third closed position includes shifting a shear sleeve, maintained in an initial position by one or more shear devices, past the one or more shear devices to enable the flow responsive sleeve to shift from the second closed position to the third closed position.

18. The method of claim 17, further comprising locking the valve in the third closed position after shifting the shear sleeve.

19. The method of claim 17, wherein the shear sleeve is positioned longitudinally apart from the flow responsive sleeve when the flow responsive sleeve is in the first open position, and shifting the shear sleeve includes abutting the shear sleeve with the flow responsive sleeve.

20. A valve for use in a wellbore, comprising:

a tubular housing having at least one opening formed through a sidewall thereof, the tubular housing connectable with a tubular string via an upper sub and a lower sub;

a replaceable choke device that is threaded into the at least one opening formed through the sidewall of the tubular housing, wherein the replaceable choke device is sealable on the sidewall of the tubular housing with an elastomeric sealing component, and wherein the replaceable choke device controls at least one of fluid pressure within the tubular string, and a pressure drop across the valve;

a flow sleeve carried by the tubular housing for movement relative thereto between a first position in which fluid flow is permitted across the valve, a second position in which the flow sleeve prevents fluid flow across the valve, and a third position in which the flow sleeve is locked in place relative to the tubular housing by a lock ring; and a shear sleeve positioned longitudinally from the flow sleeve and maintained in an initial position by one or more shear devices, wherein the flow sleeve is configured to move to the third position based on abutting the shear sleeve and shifting the shear sleeve past the one or more shear devices.

* * * * *